US006619688B2

(12) United States Patent
Billon et al.

(10) Patent No.: US 6,619,688 B2
(45) Date of Patent: Sep. 16, 2003

(54) ALPINE SKI

(75) Inventors: Pierre Billon, Voiron (FR); Eric Restani, Voiron (FR); Thierry Schrobiltgen, Attignat-Oncin (FR); Henri-Charles Deborde, Bilieu (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/884,650

(22) Filed: Jun. 19, 2001

(65) Prior Publication Data

US 2001/0052687 A1 Dec. 20, 2001

(30) Foreign Application Priority Data

Jun. 19, 2000 (FR) ..... 00 07778

(51) Int. Cl.[7] ..... A63C 5/00
(52) U.S. Cl. ..... 280/607
(58) Field of Search ..... 280/602, 607, 280/617, 618, 11.14, 11.15; D21/760, 766, 771, 773

(56) References Cited

U.S. PATENT DOCUMENTS

| | | | | |
|---|---|---|---|---|
| 2,560,693 A | | 7/1951 | Hickman | |
| 4,098,522 A | * | 7/1978 | Beyl | 280/618 |
| 4,848,781 A | * | 7/1989 | Dykema et al. | 280/14.2 |
| 4,896,895 A | | 1/1990 | Bettosini | 280/607 |
| 5,474,321 A | | 12/1995 | Pritz | 280/607 |
| 5,647,605 A | * | 7/1997 | Arduin | 280/602 |
| 5,775,716 A | * | 7/1998 | Harsanyi et al. | 280/602 |
| 5,785,342 A | | 7/1998 | Bronson | 280/602 |
| 5,820,154 A | * | 10/1998 | Howe | 280/602 |
| 5,927,743 A | * | 7/1999 | Mantel | 280/602 |
| 6,371,506 B1 | * | 4/2002 | DeNicola | 280/607 |

FOREIGN PATENT DOCUMENTS

| | | | |
|---|---|---|---|
| DE | 3712807 | * | 11/1988 |
| DE | 4101997 | * | 9/1991 |
| DE | 4317675 A1 | | 12/1994 |
| EP | 6125544 | * | 8/1994 |
| EP | 0 791 378 A2 | | 2/1997 |
| EP | 0 908 203 A1 | | 4/1999 |
| FR | 2 695 041 | | 8/1993 |

OTHER PUBLICATIONS

U.S. patent application Publication 2002/0117832—dated Aug. 2002.*

* cited by examiner

*Primary Examiner*—Brian L. Johnson
*Assistant Examiner*—Bryan Fischmann
(74) *Attorney, Agent, or Firm*—Heslin Rothenberg Farley & Mesiti P.C.; Victor A. Cardona, Esq.

(57) ABSTRACT

Alpine ski has a boot middle point mark indicating a position of a middle of a boot and is equipped with a mounting platform comprising front, central and rear zones. The platform rests on the ski via three feet situated respectively in front, central and rear zones of the platform. The height measured between the lower face of each foot and the upper face of the platform is a minimum for the central foot. The platform is anchored by screws to inhibit sliding in at least the front and central zones. An anchoring point situated in the central zone is positioned in front of the boot middle point and is separated longitudinally by a distance of between 150 and 300 millimeters. Further included is a block of elastic material inserted between a front end of the platform and a stop in front of the platform. The block is compressible during movement of the platform relative to the upper face of the ski, due to bending of the ski.

12 Claims, 3 Drawing Sheets

ALPINE SKI

CROSS REFERENCE TO RELATED APPLICATIONS

This application claims priority from French application 00 07778, filed Jun. 19, 2000.

TECHNICAL FIELD

The invention relates to the field of gliding sports and, more particularly, of Alpine skiing. It concerns more precisely Alpine skis equipped with mounting platforms for the elements of the binding.

BACKGROUND

It is generally known to equip the upper face of an Alpine ski with a mounting platform intended to hold the elements of the binding, namely the toe piece and the heel piece.

This type of platform fulfills several functions, in particular that of raising the level of the toe piece and of the binding in order, for example, to prevent the sides of the boot from coming into contact with the snow when the board is inclined.

In the large majority of cases, the platforms are produced by manufacturers other than those who develop and market the skis. Further, these platforms are most often sold so that they can be fitted on any commercially available ski, irrespective of its brand and its features.

A constant concern with this type of platform involves the interaction of the stiffness of the platform with the intrinsic stiffness of the board. To be precise, in particular depending on how it is anchored on the upper face of the ski, the platform inevitably increases the stiffness of the assembly and therefore interferes with the intrinsic stiffness of the board, whose structure and dimensions are designed so that it exhibits specific mechanical properties.

This is why, in general, it is desirable to limit the influence of the stiffness of the platform with respect to that of the board. Hence, as is known, the platform is fitted on the ski so that at least one of its ends has a capacity for longitudinal relative movement in relation to the board.

Solutions of this type have been described, in particular, U.S. Pat. No. 4,896,895. The platforms described in this document have an end which comprises an elongate opening, inside which a member secured to the upper face of the ski can slide. Since the other end of the platform is firmly anchored in the board, the various bending movements of the board cause one end of the platform to slide in relation to the upper face of the board. This limits the influence of the stiffness of the platform with respect to that of the board. Such a decoupling phenomenon is generally desired.

Other embodiments, such as the one illustrated U.S. Pat. No. 2,560,693, use a platform that is fixed by its central part in the ski, and each end of which is connected to the upper face of the ski so as to permit relative displacement by longitudinal sliding.

German Patent No. DE 4 317 675, corresponding to U.S. Pat. No. 5,474,321, describes another type of platform comprising a central support zone through which elements for binding to the ski pass. The front and rear ends of this platform are cantilevered above the upper surface of the board.

All these solutions aim to reduce the rigidifying side effect which the ski receives from the platform, in order to let the ski keep the mechanical features which were defined for it by its designer so that it complies with a specific product range.

One problem which the invention proposes to solve is that of integrating the stiffness features of the platform with the stiffness of the ski, starting with the design of the latter. Since the platform is an extra part attached to the ski, the means for anchoring on the ski, like the connecting surfaces between the ski and the platform, need to satisfy a number of constraints.

To be precise, it will be understood that when the two ends of the board are firmly anchored by screwing, for example, on the upper face of the board, excessive mechanical stresses are created in the screws or the means for anchoring the platform on the board, because the platform is relatively rigid.

Very large shear forces are exerted on the screws when the board deforms while, conversely, the platform stays straight.

One problem which the invention proposes to solve is that of providing the board/platform assembly with controlled rigidity, while allowing the platform to be anchored in a mechanically reliable and efficient way.

SUMMARY OF THE INVENTION

The invention relates to an Alpine ski having a boot middle mark or point indicating the position of the middle of the boot, and equipped with a mounting platform comprising front, central and rear zones.

This assembly is characterized in that:

- the platform rests on the ski via three feet situated respectively in the front, central and rear zones of the platform, the height measured between the lower face of the foot and the upper face of the platform being a minimum for the foot situated in the central zone;
- the platform is anchored without sliding on the ski at least in the front and central zones, the anchoring point situated in the central zone being positioned in front of the boot middle point situated on the ski, the anchoring points being separated longitudinally by a distance of between 150 and 300 millimeters;
- the ski comprises a block of elastic material inserted between the front end of the platform and a support zone situated in front of the platform, said block being compressible during the relative movements of the platform in relation to the upper face of the ski, due to bending of the latter.

In other words, the platform bears on the board at three points forming support wedges, the thicknesses of which are determined so as to avoid compromising the natural curvature of the board, the thickness of which is a maximum in proximity to the central zone of the platform.

The stresses exerted on the anchoring foot are also reduced to some extent by the presence of a compressible element situated in front of and/or behind the ends of the platform.

Further, it has been observed that the stresses exerted on the front and central anchoring points are acceptable, without weakening the assembly, if the two points are separated by a distance of less than 300 millimeters and, on the other hand, if the platform acts in opposition to the deformation of the ski via the elastic block inserted between the end of the platform and the support zone situated on the ski, facing the end of the platform.

Further, it has been observed that the stresses exerted on the anchoring screws are less when the platform is screwed onto the board in front of the boot middle point.

In practice, the feet of the platform may consist of extra independent elements that form a support wedge and are fitted between the lower face of the platform and the upper face of the board, or which alternatively are an integral part of the platform and form protuberances under the lower face of the latter.

In practice, good results have been obtained concerning the ability of the anchoring screws to withstand forces when the intermediate anchoring point is situated in the central zone of the platform, but without necessarily being situated in the geometrical middle of the latter.

In a preferred form, the anchoring points in the central and front zones are separated longitudinally by a distance of between 200 and 230 millimeters.

Moreover, the positioning of the platform on the ski determines the stiffness distribution. Hence, according to the invention, the central anchoring point is advantageously arranged in front of the boot middle marker drawn on the ski, that is to say between 5 and 50 millimeters forward in the direction of the tip and, advantageously, between 20 and 35 millimeters.

Advantageously, in practice, the ski may comprise a second block of elastic material, which comes into contact with the rear end of the platform and is also compressible during the relative movements of the platform in relation to the upper face of the board.

In a preferred form, the platform may comprise a rear anchoring point, that is to say one situated close to the rear foot, and this anchoring point may be designed to connect the rear of the platform to the ski with sliding or, advantageously, without sliding. The latter case involves keeping the rear of the platform bearing on the top of the ski and keeping the lateral guidance, but allowing the ski to displace longitudinally at this anchoring point.

Advantageously, in practice, the block or blocks may have a hardness of between 40 Shore A and 95 Shore A.

In a particular form, the hardness of the front block may be greater than that of the rear block, and this makes it possible to stiffen the front of the ski, which is beneficial because it is the front of the ski that, by carving firmly in the snow, permits good control when turning (without side slipping or juddering).

BRIEF DESCRIPTION OF THE FIGURES

The way in which the invention is embodied, and the advantages that result therefrom, will become readily apparent from the following description of the embodiments with the aid of the appended figures, in which.

DETAILED DESCRIPTION

As already mentioned, the invention relates to an Alpine ski equipped with a platform for raising the binding.

Figure 1:
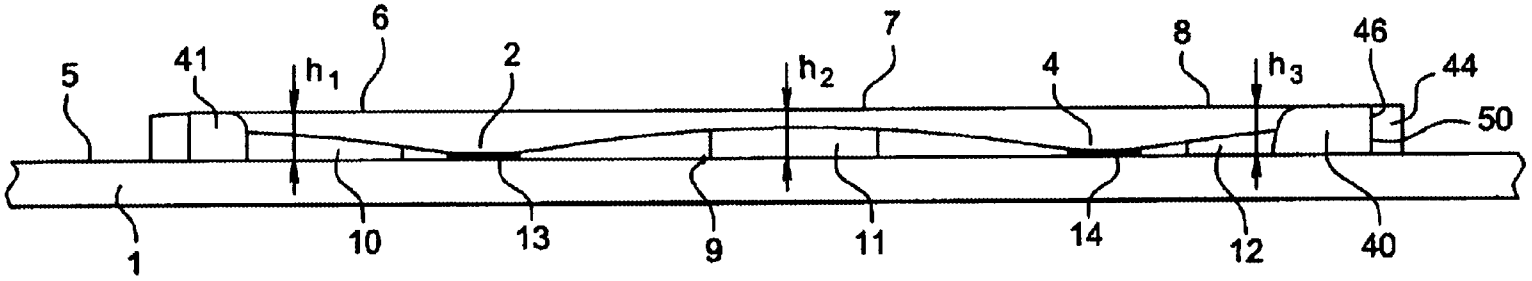
FIG. 1 is a side view of the bearing zone of a ski equipped with a platform according to the invention.

More precisely, as illustrated in FIG. 1, the gliding board (1) receives the platform (2) in its bearing zone. This platform (2) consists of a metal plate that has a constant width over substantially its entire length.

Quite clearly, the invention is not limited to this geometry but covers other variants in which the width of the platform can be variable.

In the form illustrated in FIG. 1, the platform (2) comprises, on either side, two extensions (3, 4) which virtually come into contact with the upper face (5) of the board (1).

In one embodiment, these extensions bear on wedges of viscoelastic material or of ABS (acrylonitrile-butadiene-styrene).

These wedges (13, 14) permit more direct transmission of forces in the direction of the edges. Nevertheless, the invention covers alternative embodiments in which these extensions are not provided.

The platform (2) can be produced using various techniques. For instance, it may be a profiled section having longitudinal cavities intended to reduce the weight of the platform proper. The platform may also be produced from a solid plate or the like.

As already mentioned, the platform (2) rests on the upper face (5) of the ski via three feet (10, 11, 12) situated respectively in the rear (6), central (7) and front (8) zones of the platform.

Figure 5:
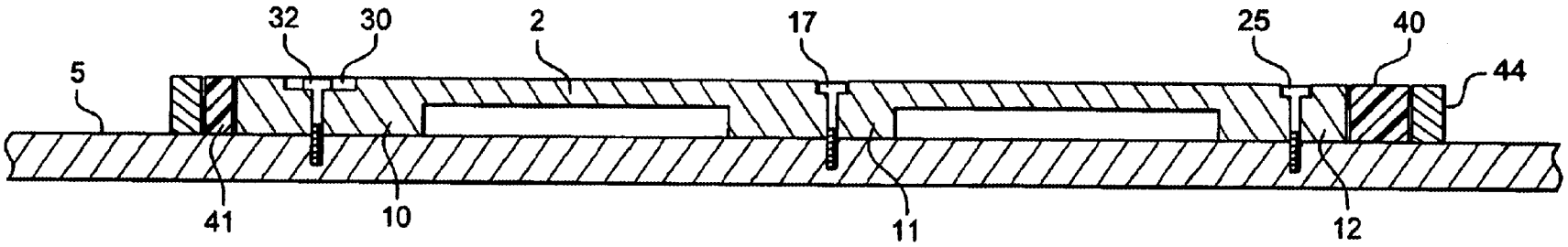
FIG. 5 is a side view of another embodiment of the bearing zone of a ski equipped with a platform according to the present invention.

The feet (10, 11, 12) may consist, in the form illustrated, of independent support wedges added when fitting the platform (2) on the board (1). Also as depicted in FIG. 5, the feet may he integral to the platform. Further, they may, in a form which is not represented, consist of two protuberances that are an integral part of the platform. These feet (10, 11, 12) make it possible to elevate the platform (2) proper. According to one feature of the invention, the foot (11) situated in the central zone (7) has a height $h_2$ smaller than the heights $h_1$, $h_3$ of the feet (10, 12) respectively situated in the rear (6) and front (8) zones of the platform.

More precisely, the height $h_1$, $h_2$, $h_3$ of each foot is measured between the lower face of the foot (10, 11, 12) and the upper face of the platform (2).

In practice, the height difference between the central foot (11) and the front and rear two feet (10, 12) is of the order of 1 millimeter. In this way, the natural curvature of the ski is not compromised when fitting the platform (2).

The mounting platform (2) is secured to the board (1) by screwing in at least the front zone (8) and the central zone (7). More precisely, in the form illustrated in FIG. 2, the platform (2) comprises, in the central zone (7), two orifices (15, 16) receiving two screws (17, 18). These two screws (17, 18) have a head whose thickness is accommodated inside the platform. The diameter of these screws corresponds substantially to the through openings (19, 20) made in the wedge (11), so that the screws (17, 18) are fitted on the board with minimal play in relation to the platform.

According to one feature of the invention, the two screws (17, 18) are arranged in front of the mark (9) which is situated on the ski and shows the position of the middle of the boot. More precisely, in the example illustrated, the two screws (17, 18) are separated from the boot middle point (9) by a distance d1 of 27 millimeters in the direction of the tip.

In the front zone (8), the platform comprises two other orifices (23, 24) receiving two screws (25, 26). These two screws (25, 26) pass through the rear foot (e.g., rear wedge) (12) with minimal mechanical play, then are anchored in the structure of the board (1).

Figure 2:
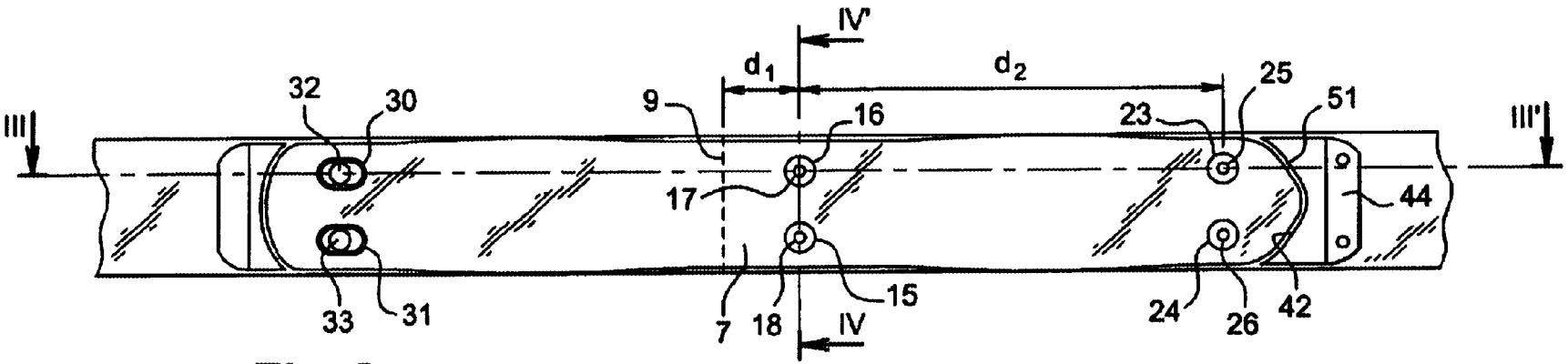
FIG. 2 is a top view of FIG. 1.
Figure 3:
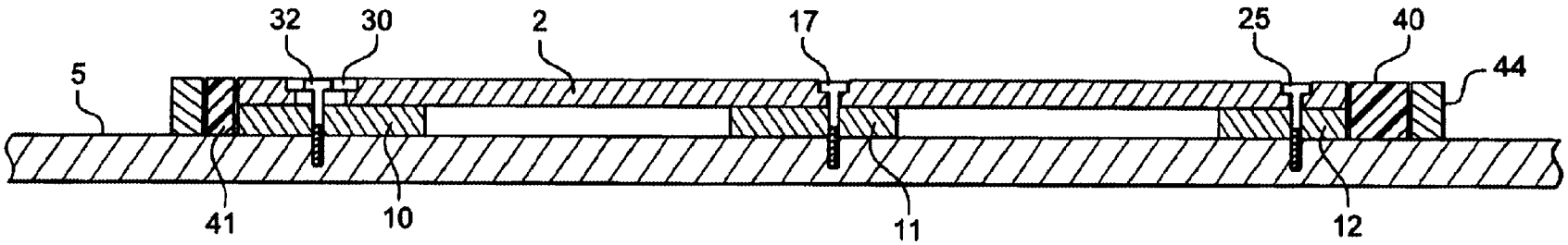
FIG. 3 is a view in longitudinal section on the plane III–III' of FIG. 2.
Figure 4:
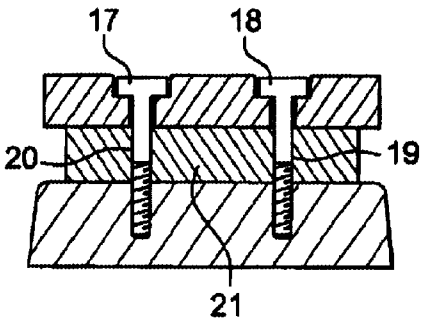
FIG. 4 is a view in cross section on the plane IV–IV' of FIG. 2.

In the form illustrated in FIG. 2, the screws (25, 26) are separated from the screws (17, 18) of the central zone (7) by a distance d2 equal to 223 millimeters. Of course, these distances are given only by way of example, and the invention covers the variants in which these distances are adapted according to the geometry of the board and of the platform.

In the rear zone (6), the platform comprises two elongate through holes (30, 31), into which screws (32, 33) penetrate. These holes (30, 31) comprise a shoulder intended to prevent any upward movement of the platform (2). The holes (30, 31) are elongate in a longitudinal direction to permit slight sliding of the rear zone (6) of the platform in relation to the anchoring point constituted by the screws (32, 33). The screws (32, 33) pass through the rear foot (e.g., rear wedge) (10) via holes which may either be elongate, if the wedge is secured to the platform, or have a diameter identical to that of the screws (32, 33), if the wedge is free in relation to the platform (2).

Figure 6:
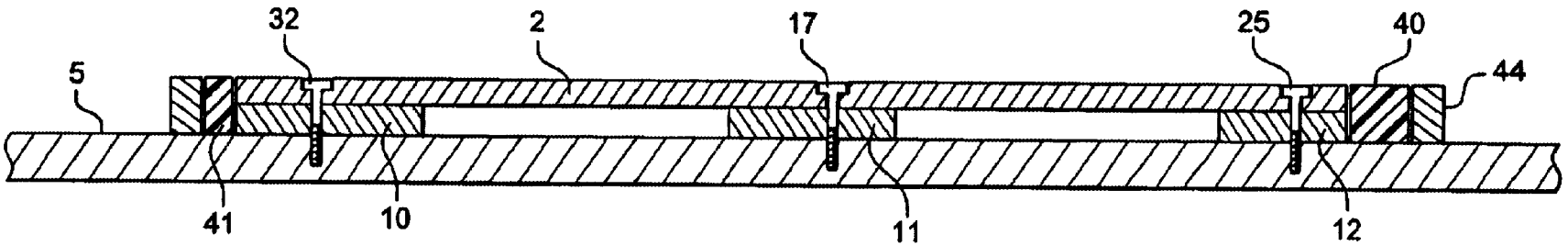
FIG. 6 is a side view of yet a further embodiment of the bearing zone of a ski equipped with a platform according to the present invention.

In an embodiment depicted in FIG. 6, the rear zone (6) of the platform may also be firmly anchored in relation to the board, and therefore comprise three zones for securing on the board, which increases the stiffness of the assembly.

According to another feature of the invention, the ski comprises two blocks (40, 41) which come into contact with the end of the platform (2). More precisely, the front block (40) comprises a rear face (42) which comes into contact with the front end (51) of the platform (2).

The geometry of the block (40) can be adapted according to that of the platform (2), for example in order to increase the contact area. In the form illustrated, the block (40) is combined with a stop (44) which is secured to the upper face of the board so as to constitute a fixed zone of the ski, against which the front face (46) of the block (40) bears. In this way, when the ski (1) bends, and the front stop (44) therefore tends to move toward the face of the platform (2), the block (40) is compressed between the front end (51) of the platform and the rear face (50) of the stop (44). In this way, the stresses generated on the screws (25, 26) are to some extent supported by the block (40), which limits the risks of shearing the attachment screws (25, 26).

Quite clearly, other ways of fitting the block on the board may be envisaged, so long as the principle of the invention is respected and the block (40) is compressible when the ski bends. For instance, it is possible to secure the block (40) exclusively by adhesive bonding on the upper face of the board, or alternatively by screwing through the thickness of the block (40) proper, and also by using the screws (25, 26) to grip an extension of the block passing to the rear under the platform.

The stop may also consist of a stud formed in the actual structure of the upper face of the ski.

Likewise, the invention is not limited just to the embodiment in which the two ends of the platform are equipped with a block of elastic material, but also covers the variants in which only one of these blocks is present.

In practice, the blocks (40, 41) consist of an elastic material such as natural rubber, the stiffness of which has an effect on the response of the ski.

For instance, when the material for producing the block (40) has a hardness of between 40 Shore A and 70 Shore A, the ski according to the invention has a relatively comfortable response more particularly intended for multipurpose use.

Conversely, when the rubber that is used has a hardness of between 70 and 95 Shore A (corresponding to 45 Shore D), the response of the ski is stiffer and therefore makes such a ski suitable for competitive use. In the event that the ski comprises two blocks, i.e. a front block and a rear block, mixes in the hardnesses of the blocks make it possible to optimize the response.

When combining these various arrangements, it was observed that the mechanical stresses experienced by the attachment screws intended to clamp the board are not excessive, which makes the assembly considerably reliable.

It can be seen from the description above that the ski according to the invention has the following advantages:

- integration of the stiffness of the platform with that of the board;
- possibility of varying the response by varying the different parameters: rear clamping or no rear clamping, front block, rear block, different hardnesses;
- opportunity to clamp the platform in relation to the ski while ensuring that the anchoring is mechanically reliable.

We claim:

1. An alpine ski having a boot middle point mark indicating a position of a middle of a boot, and equipped with a mounting platform comprising front, central and rear zones, wherein:

- the platform rests on the ski via a front foot, a central foot, and a rear foot situated respectively in front, central and rear zones of the platform, wherein a first height comprises a distance between a lower face of said front foot and an upper face of said platform, a second height comprises a distance between a lower face of said central foot and said upper face, and a third height comprise a distance between a lower face of said rear foot and said upper face and wherein said second height is less than said first height and said third height;
- the platform is anchored to inhibit sliding of said platform relative to said upper face of the ski by at least one screw in a front anchoring point in the front zone and a central anchoring point in said central zone, the central anchoring point being positioned in front of the boot middle point, the front anchoring and the central anchoring point being separated longitudinally by a separation distance of between 150 and 300 millimeters;
- the ski further comprising a block of elastic material inserted between a front end of the platform and a stop in front of the platform, said block being compressible during movement of the platform relative to the upper face of the ski, the movement being due to bending of the ski.

2. The alpine ski according to claim 1, wherein said front foot, said central foot, and said rear foot are an integral part of the platform and form protuberances under a lower face of said platform.

3. The alpine ski according to claim 1, wherein said front foot, said central foot, and said rear foot comprise a plurality of independent support wedges fitted between a lower face of the platform and the upper face of the ski.

4. The alpine ski according to claim 1, wherein said central anchoring point is separated from the boot middle point by a second separation distance of between 5 and 50 millimeters.

5. The alpine ski of claim 4, wherein said distance comprises a distance between 20 and 35 millimeters.

6. The alpine ski according to claim 1, wherein said separation distance comprises between 200 and 230 millimeters.

7. The alpine ski according to claim 1, wherein the block has a hardness of between 40 Shore A and 95 Shore A.

8. The alpine ski according to claim 1, further comprising a second block of elastic material, which comes into contact with a rear end of the platform and is compressible during movement of the platform relative to the upper face of the ski.

9. The alpine ski according to claim 8, wherein a hardness of the block is greater than the hardness of the second block.

10. The alpine ski according to claim 1, wherein the rear zone of the platform is anchored to inhibit sliding of said platform relative to the ski.

11. The alpine ski according to claim 1, wherein the rear zone of the platform is anchored to the ski to allow sliding of said platform relative to the ski.

12. The alpine ski according to claim 1, wherein the platform has two vertical extensions bearing on the upper face of the ski via wedges of viscoelastic material.

* * * * *